US010640925B2

(12) United States Patent
Mallya

(10) Patent No.: US 10,640,925 B2
(45) Date of Patent: May 5, 2020

(54) LIGHTWEIGHT PAPER BOARD

(71) Applicant: FLEX R&D, INC., Beverly Hills, CA (US)

(72) Inventor: Prakash Mallya, Sierra Madre, CA (US)

(73) Assignee: Flex R&D Inc., Beverly Hills, CA (US)

( * ) Notice: Subject to any disclaimer, the term of this patent is extended or adjusted under 35 U.S.C. 154(b) by 0 days.

(21) Appl. No.: 16/481,820

(22) PCT Filed: Feb. 13, 2018

(86) PCT No.: PCT/US2018/017930

§ 371 (c)(1),
(2) Date: Oct. 7, 2019

(87) PCT Pub. No.: WO2018/152082

PCT Pub. Date: Aug. 23, 2018

(65) Prior Publication Data

US 2019/0376234 A1 Dec. 12, 2019

Related U.S. Application Data

(60) Provisional application No. 62/459,119, filed on Feb. 15, 2017.

(51) Int. Cl.
*D21F 11/00* (2006.01)
*D21H 11/10* (2006.01)
(Continued)

(52) U.S. Cl.
CPC ..... *D21F 11/002* (2013.01); *D21H 11/10* (2013.01); *D21H 17/55* (2013.01); *D21H 21/24* (2013.01); *D21H 27/10* (2013.01); *D21H 27/30* (2013.01)

(58) Field of Classification Search
None
See application file for complete search history.

(56) References Cited

U.S. PATENT DOCUMENTS 4,078,715 A * 3/1978 Larsson ..... B65D 5/062 229/216
4,543,156 A * 9/1985 Cheshire ..... D21F 11/002 162/101
(Continued)

FOREIGN PATENT DOCUMENTS

EP 1 936 032 A1 6/2008
EP 2 949 597 A1 12/2015
(Continued)

OTHER PUBLICATIONS

"Kemira's strength resins deliver results", Kemira, 2 pages, 2015, [online], retrieved from the Internet, [retrieved Nov. 26, 2019],<URL: http://pages.kemira.com/strength-resin.html>. (Year: 2015).*
(Continued)

*Primary Examiner* — Dennis R Cordray
(74) *Attorney, Agent, or Firm* — Ranjendra G. Sardesai

(57) ABSTRACT

A fibrous material, method for making the same, and articles comprising the same are shown and described. The fibrous material is a low density material that exhibits high strength properties. In embodiments, the fibrous material has a density of 0.15 g/cm$^3$ or less and a tensile strength of 10 N/inch or greater. The fibrous material may be in the form of a paperboard and is suitable for use in a variety of applications including as a packaging material.

21 Claims, 4 Drawing Sheets

(51) Int. Cl.

| | |
|---|---|
| ***D21H 17/55*** | (2006.01) |
| ***D21H 21/24*** | (2006.01) |
| ***D21H 27/30*** | (2006.01) |
| ***D21H 27/10*** | (2006.01) |

(56) References Cited

U.S. PATENT DOCUMENTS

| | | | |
|---|---|---|---|
| 2005/0090789 | A1 | 4/2005 | Graef et al. |
| 2006/0005934 | A1 | 1/2006 | Graef et al. |
| 2013/0133848 | A1 | 5/2013 | Heijnesson-Hulten et al. |
| 2015/0114581 | A1 | 4/2015 | Kinnunen et al. |
| 2017/0120556 | A1* | 5/2017 | Nyman ..... B32B 5/18 |

FOREIGN PATENT DOCUMENTS

| | | | |
|---|---|---|---|
| WO | WO 2015/036659 | A1 | 3/2015 |
| WO | WO 2016/197156 | A1 | 12/2016 |
| WO | WO 2017/006216 | A1 | 1/2017 |

OTHER PUBLICATIONS

Braga et al, "Recent Developments in Wet Strength Chemistry Targeting High Performance and Ambitious Environmental Goals", Professional Papermaking, 3-4 (2009), pp. 30-34. (Year: 2009).*

International Search Report in International application No. PCT/US2018/017930 dated Aug. 23, 2018.

PCT Written Opinion Internation Application No. PCT/US2018/017930 dated Aug. 23, 2018.

Strength chemistry for board and tissue production: Scientific outlook and end applications, Grigoriev V et al, Kemira Technical Paper, St. Petersburg, Russia, 2012.

Ultra-lightweight paper foams: processing and properties, A. Madani et al, Cellulose, Published Online Feb. 18, 2014, Springer.

* cited by examiner

LIGHTWEIGHT PAPER BOARD

CROSS REFERENCE TO RELATED APPLICATIONS

The present application claims priority to and the benefit of U.S. Provisional Patent Application No. 62/459,119 filed on Feb. 15, 2017, the entire disclosure of which is incorporated herein by reference.

FIELD OF INVENTION

The present invention relates to a composition and method for making a lightweight fibrous web, a paperboard formed from such a fibrous web and an article comprising the paperboard material. In particular, the present invention relates to a fibrous web that has a low density and good mechanical properties and can be used to form a paperboard product as may be used in a packaging material.

BACKGROUND

The paper and paperboard industry is a $39 billion/year industry in the United States. Dating back to the 1800s, paper has been made by a process of taking wood or other fibers in water to form a slurry and filtering and drying these slurries on a continuous press. These slurries have a low solids content of the range of 0.5 to 2% and require large amounts of energy to make the finished product. Such paperboards made on a conventional paper machine, such as a Fourdrinier, have densities of 0.3 g/cc or higher depending on further processing such as calendaring. Such paperboards are widely used for all kinds of packaging applications by various industries.

Over the years, attempts have been made to make lower density papers. U.S. Pat. No. 3,716,449 describes a process for making non-woven webs using a foamed fiber dispersion. The examples describe making filter papers, which are generally known to be weak in strength. U.S. Pat. Nos. 3,871,952 and 4,994,843 focus on improving the process of manufacturing such non-woven products. U.S. Pat. No. 4,443,297 describes a method for making non-woven fibrous webs using a foamable liquid that is deposited onto the web.

An article published in the journal Cellulose (A. Madani, S. Zeinoddini, S. Varahmi, H. Turnbull, A. B. Phillion, J. A. Olson and D. M. Martinez, Feb. 18, 2014) describes a method for making ultra-lightweight paper foams. This article describes a method for making paper with ultra-low density (as low as 0.01 g/cc). The mechanical properties described in the paper, however, are very poor.

Although foam forming has been known and has been practiced for some time, the key challenge that has stopped it becoming mainstream is that the mechanical properties of the resulting foam papers are too weak when the density is lowered.

U.S. Publication No. 2015/0114581 describes a method for making foamed paper using microfibrillated cellulose (MFC). The '581 publication describes using 5 to 40 wt % of MFC along with 60 to 95 wt % of pulp having a fiber length greater than the MFC and achieving densities as low as 0.143 g/cc (bulk density of 7 cc/g). The '581 publication describes that, with foamed paper, the structure becomes bulkier (more porous and low density), which leads to smaller tensile strength values. Although the mechanical properties of the foamed paper containing MFC is described as being improved relative to foamed papers containing no MFC, the relative drop in mechanical properties of the foamed paper compared to the products without foam is very significant. In particular, there is a greater than 50% loss in mechanical property when the density is lowered from 0.5 g/cc to 0.25 g/cc (400 j/m$^2$ at a bulk density of 2 cc/g or density of 0.5 g/cc compared to less than 200 j/m$^2$ at a bulk density of 4 cc/g or density of 0.25 g/cc).

Strengthening additives have been used on the wet end of making paperboard. Such agents include water-soluble polyimines, anionic and cationic polyacrylamides, and cationic starches. Despite this, foamed papers or paperboard with lower density and pulp usage and mechanical properties equivalent to that of normal paper are generally not available.

SUMMARY

The following presents a summary of this disclosure to provide a basic understanding of some aspects. This summary is intended to neither identify key or critical elements nor define any limitations of embodiments or claims. Furthermore, this summary may provide a simplified overview of some aspects that may be described in greater detail in other portions of this disclosure.

Provided is a composition for making a fibrous web, a fibrous web made from such material, a paperboard formed from the fibrous web, and an article formed from such a material. The fibrous web has a low density and good mechanical properties. In embodiments, the fibrous web and paperboard formed therefrom exhibit a high tensile strength.

In one embodiment, the fibrous web has a density of about 0.15 g/cc or less.

In one embodiment, the fibrous web has a tensile strength of about 10 N/inch or higher.

It has been found that a combination of polyaminoamide epichlorohydrin (PAE) resin and a fibrillated cellulose provide a fibrous web with a low density and excellent mechanical properties. In one embodiment, a fibrous web with PAE at levels of about 0.5 to about 2 wt % based on dry paper pulp, along with very low levels of NFC and/or MFC (3.5 to 10 wt % based on dry paper pulp) provides a paperboard foam having a density of less than 0.15 g/cc, even as low as 0.02 g/cc, and a tensile strength that matches or exceeds that of unfoamed paper with a density of 0.37 g/cc. While not being bound to any particular theory, the PAE amine is believed to form a crosslinked network with NFC or MFC and the paper fibers.

In one aspect, provided is a composition comprising: (a) a fibrous material; (b) a fibrillated cellulose chosen from microfibrillated cellulose, nanofibrillated cellulose, or a combination thereof; (c) polyaminoamide epichlorohydrin; (d) a surfactant; and (e) water.

In one embodiment, the fibrillated cellulose is present in an amount of from about 3.5 wt % to about 10 wt % based on the dry weight of the fibrous material.

In one embodiment, wherein the fibrillated cellulose is present in an amount of from about 4 wt % to about 9 wt % based on the weight of dry fibrous material.

In one embodiment, wherein the fibrillated cellulose is present in an amount of from about 5 wt % to about 7.5 wt % based on the weight of dry fibrous material.

In one embodiment, provided is a composition according to any previous embodiment, wherein the polyaminoamide epichlorohydrin is present in an amount of from about 0.5 wt % to about 2.5 wt %, based on the dry weight of the fibrous material.

In one embodiment, provided is a composition according to any previous embodiment, wherein the polyaminoamide epichlorohydrin is present in an amount of from about 0.75 wt % to about 2 wt %, based on the dry weight of the fibrous material.

In one embodiment, provided is a composition according to any previous embodiment, wherein the polyaminoamide epichlorohydrin is present in an amount of from about 1 wt % S to about 1.5 wt %, based on the dry weight of the fibrous material.

In one embodiment, provided is a composition according to any previous embodiment, wherein the fibrillated cellulose is present in an amount of from about 3.5 wt % to about 10 wt % based on the dry weight of the fibrous material, and the polyaminoamide epichlorohydrin is present in an amount of from about 0.5 wt % to about 2.5 wt %, based on the dry weight of the fibrous material.

In one embodiment, provided is a composition according to any previous embodiment, wherein the composition is in the form of a slurry and comprises from about 30% by volume to about 60% by volume of a gas entrained therein. In one embodiment, the gas is chosen from air, nitrogen, oxygen, argon, or carbon dioxide.

In another aspect, provided is a method for forming a fibrous paperboard web comprising: (i) providing a composition comprising: (a) a fibrous material; (b) fibrillated cellulose chosen from microfibrillated cellulose, nanofibrillated cellulose, or a combination thereof; (c) epichlorohydrin; (d) a surfactant; and (e) water;

(ii) mixing the composition in the presence of a gas to form a foamed composition:

(iii) supplying the foamed composition onto a forming fabric; and (iv) dewatering the foamed composition to form a dry fibrous paperboard product.

In one embodiment, the fibrillated cellulose is present in an amount of from about 3.5 wt % to about 10 wt % based on the dry weight of the fibrous material.

In one embodiment, wherein the fibrillated cellulose is present in an amount of from about 4 wt % to about 9 wt % based on the weight of dry fibrous material.

In one embodiment, wherein the fibrillated cellulose is present in an amount of from about 5 wt % to about 7.5 wt % based on the weight of dry fibrous material.

In one embodiment, provided is a method according to any previous embodiment, wherein the polyaminoamide epichlorohydrin is present in an amount of from about 0.5 wt % to about 2.5 wt %, based on the dry weight of the fibrous material.

In one embodiment, provided is a method according to any previous embodiment, wherein the polyaminoamide epichlorohydrin is present in an amount of from about 0.75 wt % to about 2 wt %, based on the dry weight of the fibrous material.

In one embodiment, provided is a method according to any previous embodiment, wherein the polyaminoamide epichlorohydrin is present in an amount of from about 1 wt % to about 1.5 wt %, based on the dry weight of the fibrous material.

In one embodiment, provided is a method according to any previous embodiment, wherein the fibrillated cellulose is present in an amount of from about 3.5 wt % to about 10 wt % based on the dry weight of the fibrous material, and the polyaminoamide epichlorohydrin is present in an amount of from about 0.5 wt % to about 2.5 wt %, based on the dry weight of the fibrous material.

In one embodiment, provided is a method according to any previous embodiment, wherein the composition is in the form of a slurry and comprises from about 30% by volume to about 60% by volume of a gas entrained therein. In one embodiment, the gas is chosen from air, nitrogen, oxygen, argon, or carbon dioxide.

In still another aspect, provided is a foamed paperboard comprising (a) a fibrous material; (b) a fibrillated cellulose chosen from microfibrillated cellulose, nanofibrillated cellulose, or a combination thereof; (c) polyaminoamide epichlorohydrin; and (d) a surfactant.

In one embodiment, the fibrillated cellulose is present in an amount of from about 3.5 wt % to about 10 wt % based on the dry weight of the fibrous material.

In one embodiment, wherein the fibrillated cellulose is present in an amount of from about 4 wt % to about 9 wt % based on the weight of dry fibrous material.

In one embodiment, wherein the fibrillated cellulose is present in an amount of from about 5 wt % to about 7.5 wt % based on the weight of dry fibrous material.

In one embodiment, provided is a foamed paperboard according to any previous embodiment, wherein the polyaminoamide epichlorohydrin is present in an amount of from about 0.5 wt % to about 2.5 wt %, based on the dry weight of the fibrous material.

In one embodiment, provided is a foamed paperboard according to any previous embodiment, wherein the polyaminoamide epichlorohydrin is present in an amount of from about 0.75 wt % to about 2 wt %, based on the dry weight of the fibrous material.

In one embodiment, provided is a foamed paperboard according to any previous embodiment, wherein the polyaminoamide epichlorohydrin is present in an amount of from about 1 wt % to about 1.5 wt %, based on the dry weight of the fibrous material.

In one embodiment, provided is a foamed paperboard according to any previous embodiment, wherein the fibrillated cellulose is present in an amount of from about 3.5 wt % to about 10 wt % based on the dry weight of the fibrous material, and the polyaminoamide epichlorohydrin is present in an amount of from about 0.5 wt % to about 2.5 wt %, based on the dry weight of the fibrous material.

In one embodiment, provided is a foamed paperboard according to any previous embodiment, wherein the paperboard comprises from about 30% by volume to about 60% by volume of a gas entrained therein. In one embodiment, the gas is chosen from air, nitrogen, oxygen, argon, or carbon dioxide.

In one embodiment, provided is a foamed paperboard according to any previous embodiment, wherein the paperboard has a density of about 0.15 g/cm$^3$ or less.

In one embodiment, provided is a foamed paperboard according to any previous embodiment, wherein the paperboard as a tensile strength of 10 N/inch or greater.

In still another aspect, provided is an article comprising a foamed paperboard material, the foamed paperboard material comprising (a) a fibrous material; (b) a fibrillated cellulose chosen from microfibrillated cellulose, nanofibrillated cellulose, or a combination thereof; (c) polyaminoamide epichlorohydrin; and (d) a surfactant.

In one embodiment, the fibrillated cellulose is present in an amount of from about 3.5 wt % to about 10 wt % based on the dry weight of the fibrous material.

In one embodiment, wherein the fibrillated cellulose is present in an amount of from about 4 wt % to about 9 wt % based on the weight of dry fibrous material.

In one embodiment, wherein the fibrillated cellulose is present in an amount of from about 5 wt % to about 7.5 wt % based on the weight of dry fibrous material.

In one embodiment, provided is an article according to any previous embodiment, wherein the polyaminoamide epichlorohydrin is present in an amount of from about 0.5 wt % to about 2.5 wt %, based on the dry weight of the fibrous material.

In one embodiment, provided is an article according to any previous embodiment, wherein the polyaminoamide epichlorohydrin is present in an amount of from about 0.75 wt % to about 2 wt %, based on the dry weight of the fibrous material.

In one embodiment, provided an article according to any previous embodiment, wherein the polyaminoamide epichlorohydrin is present in an amount of from about 1 wt % to about 1.5 wt %, based on the dry weight of the fibrous material.

In one embodiment, provided is an article according to any previous embodiment, wherein the fibrillated cellulose is present in an amount of from about 3.5 wt % to about 10 wt % based on the dry weight of the fibrous material, and the polyaminoamide epichlorohydrin is present in an amount of from about 0.5 wt % to about 2.5 wt %, based on the dry weight of the fibrous material.

In one embodiment, provided is an article according to any previous embodiment, wherein the paperboard comprises from about 30% by volume to about 60% by volume of a gas entrained therein. In one embodiment, the gas is chosen from air, nitrogen, oxygen, argon, or carbon dioxide.

In one embodiment, provided is an article according to any previous embodiment in the form of a container comprising three or more walls defining an opening between the walls, wherein at least one of the walls comprises the foamed paperboard material.

In one embodiment, the at least one of the walls comprising the foamed paperboard material is a multilayer structure, and at least one of the layers is formed from the foamed paperboard material.

In one embodiment, provided is an article according to any previous embodiment, wherein the paperboard has a density of about 0.15 g/cm$^3$ or less.

In one embodiment, provided is an article according to any previous embodiment, wherein the paperboard as a tensile strength of 10 N/inch or greater.

In one embodiment, provided is an article according to any previous embodiment, wherein the paperboard has a tensile strength of 10 N/inch to about 40 N/inch.

In still yet a further aspect, provided is an article comprising a paperboard, the paperboard comprising a low density foamed paperboard having a density of 0.15 g/cm$^3$ or less and a tensile strength of 10 N/inch or greater.

In one embodiment, the paperboard has a tensile strength of 10 N/inch to about 40 N/inch.

In one embodiment, provided is an article according to any previous embodiment, wherein the paperboard is a multilayered structure comprising a plurality of paperboard layers.

In one embodiment, wherein two or more of the plurality of paperboard layers are formed from the low density paperboard.

In one embodiment, provided is an article according to any previous embodiment, wherein the paperboard is a multilayer structure comprising (i) the low density foamed paperboard, and (ii) a second paperboard having a density of greater than 0.15 N/inch.

In one embodiment, provided is an article according to any previous embodiment, wherein the paperboard is a multilayer structure comprising (i) the low density foamed paperboard disposed between (ii) a first paperboard material having density of greater than 0.15 N/inch and a second paperboard material having a density of greater than 0.15 N/inch.

In one embodiment, provided is an article according to any previous embodiment, wherein the paperboard is a multilayer structure comprising (i) a foamed paperboard having density of greater than 0.15 N/inch having an upper surface and a lower surface. (ii) an upper layer disposed on the upper surface of the layer (i), and (iii) a lower layer disposed on the lower surface of the layer (i), wherein the upper and lower layers are independently formed from the low density paperboard.

In one embodiment, provided is an article according to any previous embodiment, wherein the article is in the form of a container comprising three or more walls defining an interior region, at least one of the three or more walls comprising the paperboard material.

The following description and the drawings disclose various illustrative aspects. Some improvements and novel aspects may be expressly identified, while others may be apparent from the description and drawings.

BRIEF DESCRIPTION OF THE DRAWINGS

The accompanying drawings illustrate various systems, apparatuses, devices and related methods, in which like reference characters refer to like parts throughout, and in which.

DETAILED DESCRIPTION

Figure 1:
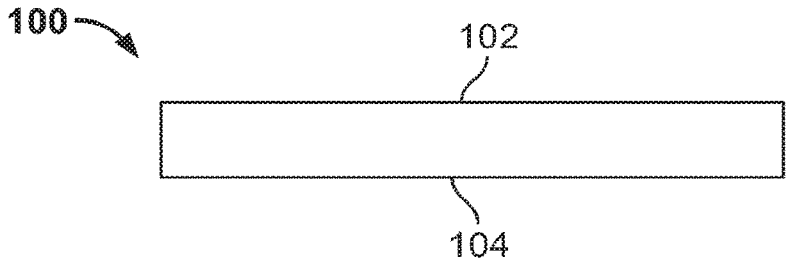
FIG. 1 is a cross section of a fibrous web/paperboard in accordance with an aspect of the invention.

Reference will now be made to exemplary embodiments, examples of which are illustrated in the accompanying drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments. In this disclosure, numerous specific details provide a thorough understanding of the subject disclosure. It should be understood that aspects of this disclosure may be practiced with other embodiments not necessarily including all aspects described herein, etc.

As used herein, the words "example" and "exemplary" means an instance, or illustration. The words "example" or "exemplary" do not indicate a key or preferred aspect or embodiment. The word "or" is intended to be inclusive rather than exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Provided is a composition for making a fibrous material, e.g., a fibrous web, that can be used as a paperboard product or can form a layer in a paperboard product. The present fibrous material and web formed therefrom exhibits a low density while maintaining excellent mechanical properties (e.g., tensile strength).

The fibrous web is formed from a fibrous composition comprising fibers, PAE, a fibrillated cellulose material, and a surfactant. It has been found that the combination of PAE with fibrillated cellulose, when foamed, provides a fibrous web that exhibits both low density and excellent mechanical properties.

The fibers can be selected from any suitable fiber as may be desired for a particular purpose or intended application. Suitable fibers may be chosen from but are not limited to, natural pulp fibers, recycled pulp fibers, or synthetic fibers. Examples of suitable natural and/or recycled fibers include, but are not limited to, thermomechanical pulp fibers, chemithermomechanical pulp fibers, kraft pulp fibers, sulphite pulp fibers, soda pulp fibers, dissolving pulp fibers, fluff pulp fibers, NBSK pulp fibers, SBSK pulp fibers, recycled pulp fibers, deinked pulp fibers, organosolv pulp fibers, bleached pulp fibers or a mixture of two or more thereof. Optionally, the natural/recycled fibers may be used in combination with synthetic polymer fibers, such as thermoplastic polymer fibers.

Examples of synthetic fibers that can be used in the composition and fibrous web include polyester fibers, aramid fibers, acrylonitrile fibers, polylactide fibers, aromatic polymide fibers, polyamide fibers, polyurethane fibers, polyethylene fibers, polypropylene fibers, and combinations of two or more thereof.

The fibrous material composition further comprises polyamineamide epichlorohydrin (PAE). The composition comprises from about 0.5 to 2.5 wt % based on the weight of the dry fibers; from about 0.75 to 2 wt % based on the dry weight of the fibers; or about 1 to 1.5 wt % based on the dry weight of the fibers.

The composition further comprises a fibrillated cellulose material. The fibrillated cellulose may be chosen from microfibrillated cellulose (MFC), nanofibrillated cellulose (NFC), or a combination thereof. These fibrils are made by mechanically or chemically breaking down cellulose fibers to the nano and micro dimensions. Due to the high surface area and large number of hydrogen bonds, these form gels in water at low concentrations and also tend to have high hydrophilicity limiting their use in papermaking. The size and/or diameter of the MFC or NFC is not particularly limited and may be selected as desired for a particular use or intended application. In one embodiment, the microfibrils of MFC typically have a fibers length of about 1 μm to 10 μm and a fibers diameter of about 3 nm to about 2 μm. In embodiments, the MFC may have a fiber diameter of from about 3 nm to about 200 nm. NFC is nanoscale cellulose microfibrils defibrillated from cellulosic materials. The NFC microfibrils have dimensions of about 100 nm to about 900 nm in length, and about 3 nm to about 2 μm. In one embodiment the NFC has a diameter of from about 3 nm to about 200 nm. In one embodiment, the NFC has a diameter of from about 500 nm to about 0.5 μm. The fibrillated cellulose is present in an amount of from about 3.5 to 10 wt % based on the weight of the dried fibers; from about 4 to about 9 wt % based on the weight of the dried fibers; or from about 5 to about 7.5 wt % based on the weight of the dry fibers.

It has been found that the combination of the PAE along with the fibrillated cellulose, when foamed, provides a foamed fibrous web having low density and excellent mechanical properties.

The composition comprises a surfactant. The surfactant may be chosen from a suitable surfactant as may be used in forming a fibrous web. Examples of surfactants include, but are not limited to, anionic surfactants, cationic surfactants, amphoteric surfactants, nonionic surfactants, or a combination of two or more thereof. Examples of suitable surfactants include, but are not limited to, ammonium lauryl ether sulfate (Polystep B11, Stepan Company), sodium C14-C16 olefin sulfonate (Bioterg AS-40, Stepan Company), sodium dodecyl sulfate, sodium dodecyl sulfonate, sulfosuccinates, ethoxylated nonyl and octyl phenol sulfonates, alkylated diphenyl oxide disulfonates, block copolymer surfactants such as Pluronics and Tetronics, etc.

The composition may include other additives as may be desirable for a fibrous web material. Such additives include, but are not limited to, pigments, thickeners, strengthening additives, covalent bonding additives, nanoparticles, fillers, etc.

Additives such as associative or alkali-swellable thickeners can be used to provide stability to the foam through rheology control and also provide sites for hydrogen or ionic bonding with the functional groups on the paper fiber. These additives also provide thickness control during paperboard manufacture. Examples of such thickeners include salts of poly(meth)acrylic acid or hydrophobically modified alkali-swellable emulsions, or hydrophobically modified ethoxylate urethanes.

Strengthening additives that can form bridges between the paper fibers can be used either alone or in combinations. These bridges can be based on (i) hydrogen bonds, (ii) ionic and hydrogen bonds, (iii) a combination of hydrogen and covalent bonds, and/or, (iv) a combination of ionic, hydrogen, and covalent bonds.

Examples of hydrogen bonding additives include, but are not limited to, (i) poly(meth)acrylic acid homopolymers and copolymers with monomers such as hydroxyethyl acrylate, acetoacetoxyethyl methacrylate, urea pyridimino methacrylate, (ii) starches. (iii) cellulosics such as hydroxyethyl cellulose, and/or carboxymethyl cellulose, (iv) polyvinyl alcohols, (v) high molecular weight water soluble or dispersible polymers with hydrogen bonding groups, (vi) emulsion copolymers partially neutralized to form an expanded core-shell network, and/or (vii) nanocrystalline cellulose. These are capable of forming hydrogen bonds with hydroxyl groups on cellulosic fibers providing the mechanical strength to the paper.

Additives capable of ionic bonding with the hydroxyl groups on the paper fiber include multivalent ionic species such as: (i) ammonium zirconium carbonate, or (ii) polymers which are cationically charged such as cationic starch, quaternary dimethylaminoethyl methacrylate, amphoteric cationic polyacrylamides. By regulating the pH of the water slurry, the zirconium ions can be made to form strong linkages with the hydroxyl groups of the cellulose fibers leading to improved mechanical properties.

Covalent bonding additives, that can react with the hydroxyl groups on the paper fiber and within the polymer network to improved mechanical strength include: (i) urea formaldehyde resins and melamine formaldehyde resins, (ii) epoxy resins, (iii) Kemira PAE resin, (iv) Hercobond™ dry strength additives such as anionic, amphoteric, cationic polyacrylamides, and/or (v) modified polyamines, etc.

Other nanoparticles, emulsion particles, dendritic, graft, or copolymers containing multi-hydrogen bonding monomers can also be incorporated alone or in combinations to further regulate the mechanical properties.

The composition is used to form a foamed fibrous web. Light weighting is achieved through foaming of the fibrous composition using a surfactant in a high shear mixer in the presence of a large volume of air so that 30 to 60% or more by volume of a gas is entrained in the slurry. An example of a suitable mixer is an Arrow variable speed electric stirrer with pitched turbine blades running at 2000 rpm. The gas can be chosen from air, oxygen, nitrogen, argon, helium, carbon dioxide, etc. In addition to air or other gases, additives such as hollow polymer particles (e.g., Expancel® WE) can also be used. These hollow particles lead to a closed foam cell structure in addition to the open foam structure obtained using air alone.

The foamed composition is supplied to a forming sheet (e.g., a forming fabric), dewatered, and dried to form a board. Dewatering may be accomplished by applying a vacuum to the wet foamed sheet. Additionally, the sheet/web may be heated for a period of time at a temperature of from about 90° C. to about 110° C.

The present fibrous web material, e.g., paperboard material, may be used in any application as suitable for such materials. The fibrous web material may be used as a single layer material or it may be combined with other materials as desired to form a multilayered structure. A multilayered structure can, in one embodiment, comprise a plurality of low density/high strength paperboards in accordance with aspects and embodiments of the invention. Alternatively, a multilayered structure may include other paperboard materials, e.g., other low density paperboards (but that might not exhibit the same strength properties as those of the present invention) and/or higher density paperboards (e.g., paperboards with a density greater than 0.15 g/cc).

In FIG. 1, a fibrous web 100 is provided having an upper surface 102 and a lower surface 104. As is discussed further herein, the surface of the web may be treated in a converting process to provide certain properties to the web including, for example, mechanical properties such as strength, reinforcement, sealing, fluid barrier properties, etc.

Figure 2:
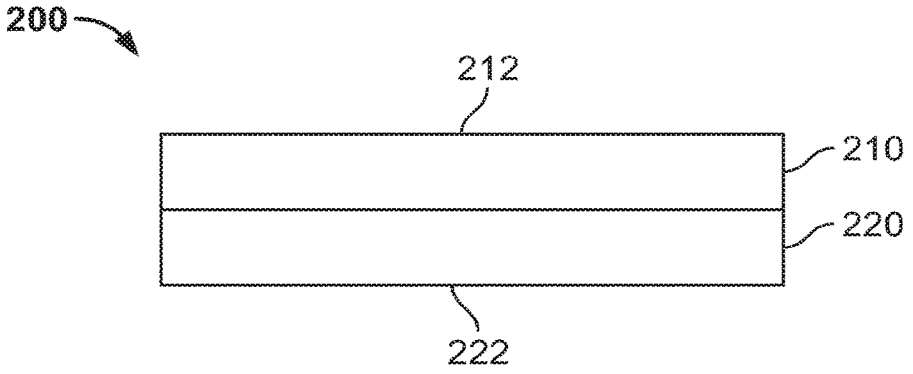
FIG. 2 is a cross section of a fibrous web/paperboard in accordance with another aspect of the invention.

The fibrous web may also be combined with other fibrous web/board structures to provide a multi-layered paperboard. In FIG. 2, a two layer fibrous web 200 is provided with a first fibrous web 210 with an upper surface 212 and a second fibrous web 220 with a lower surface 222, where at least one of the fibrous webs 210 or 220 is a fibrous web in accordance with the present invention. The other fibrous web can be provided by another suitable material, e.g., a high density fibrous web material or another low density fibrous web material.

Figure 3:
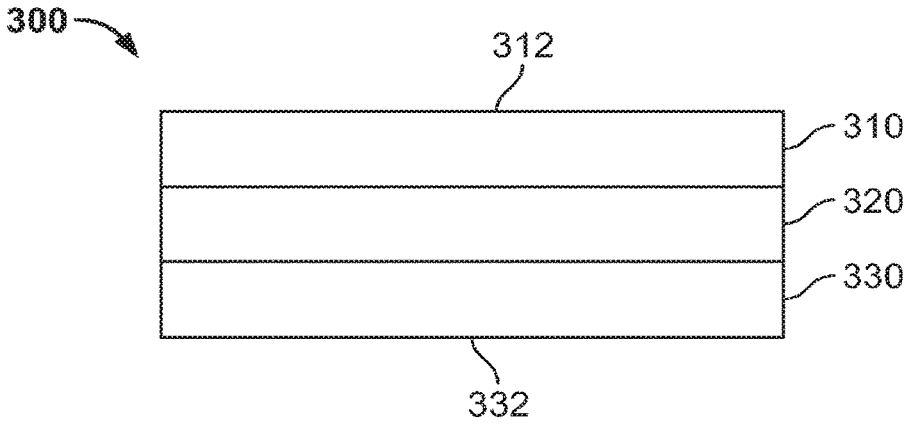
FIG. 3 is a cross section of a fibrous web/paperboard in accordance with still another aspect of the invention.

FIG. 3 shows a three layer fibrous web 300. In the embodiment of FIG. 3, the fibrous web 300 includes a low density fibrous web 320 in accordance with the present technology disposed between a fibrous web 310 having an upper surface 312 and a fibrous web 330 having a lower surface 332. The fibrous webs 310 and 330 may individually be a low density fibrous web in accordance with the present technology, other types of low density fibrous webs (e.g., low density webs that do not exhibit tensile strengths greater than 10 N/inch), a high density fibrous web, or a combination thereof.

Figure 4:
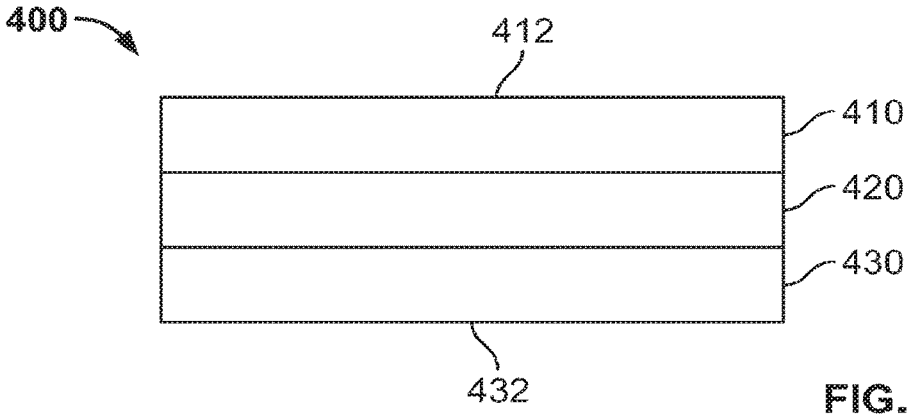
FIG. 4 is a cross section of a fibrous web/paperboard in accordance with yet a further aspect of the invention.

FIG. 4 shows a three layer fibrous web 400. In the embodiment of FIG. 4, the fibrous web 400 includes a fibrous web 420 disposed between a fibrous web 410 having an upper surface 412 and a fibrous web 430 having a lower surface 432, where the fibrous webs 410 and 430 are formed from a fibrous web in accordance with the present technology. The fibrous webs 320 may be a low density fibrous web in accordance with the present technology, other types of low density fibrous webs (e.g., low density webs that do not exhibit tensile strengths greater than 10 N/inch), or a high density fibrous web, or a combination thereof.

It will be appreciated that the multi-layered structures of FIGS. 3 and 4 are merely illustrative examples of possible arrangements of a multi-layered web that includes at least one layer formed from a low density fibrous web in accordance with the present technology, and that other embodiments with different arrangements, additional layers, etc., are within the scope of the present technology. The multi-layered board constructions may be formed by laminating the various board materials together or by successive layers being formed during the paper making process.

The foamed paperboard, or a construction comprising a foamed paperboard in accordance with the present technology, may be further treated as desired for a particular application or intended use. The foamed paperboard can be subjected to a converting step such as coating, printing, or lamination, or combinations thereof, either on one side or both sides of the paperboard construction. Converting may impart reinforcement or additional mechanical properties to the construction.

Converting steps to improve mechanical properties of foamed paperboard can involve coating, printing, extrusion coating, or laminating. Coating can be conventional water-based coating or extrusion coating either on one side of the paperboard or on both sides. There are a number of coatings that can be used to add strength to the paper. These can be starch based, PVA based, Acrylic, styrene acrylic, SBR coating, etc. The coatings can be applied via processes such as size press, blade coating, spray coating, knife over roll coating, etc. Various conventionally known printing techniques can be used either on one side or on both sides to further enhance strength properties along with aesthetics. Such a paperboard can be laminated on one or both sides with metal foil or film or metallized film to enhance strength and/or become a radiant barrier to enhance insulating characteristics. Other additives such as phase change materials can be used to add insulating properties to containers made with such a paperboard. Examples of phase change materials are waxes that have high latent heats of fusion such as Sasolwax R4250 in a binder coated on the paperboard or encapsulated phase change materials from Microtek Laboratories.

For extrusion coating on the paperboard, examples of suitable materials include, but are not limited to, polyethylene polymers (Exxon, Mobil, Dow, and Lyondel-Basell) with a melt index ranging from 10-12, ultra-low density polyethylene (less than 0.915 g/cm$^3$), low density polyethylene (0.915-0.93 g/cm$^3$), linear low density polyethylene (0.92-0.93 g/cm$^3$), medium density polyethylene (0.94-0.95 gcm$^3$), high density polyethylene (0.96 g/cm$^3$), and ethylene vinyl acetate.

Other functional films (nylon, poly-vinylidenechloride, etc.) can also be extrusion laminated to the surface of the paperboard using low viscosity PE having melt indices of 20 or greater, or other functional materials such as EVA polymer (ethylene vinyl acetate), EAA polymer (ethylene acrylic acid—DuPont Amplify), or EMA polymer ethylene methyl acrylate—Dupont Nucrel).

For some applications, adhesive lamination to laminate the paperboard to a metal foil can be used. Instead of metal foil, another embodiment can also use very thin metallized film such as 0.5 mil metallized polyester for example.

Specialty inks based on polyurethanes, epoxies, etc., can be printed in patterns or continuously to further add strength to the paper. These can be conventional inks or these inks further modified to enhance strength properties. Companies such as Siegwerk USA supply such inks for printing applications.

In the case of converted paperboard material for primary food packaging, an embodiment of the invention uses the converting process (and material) as a way to build mechanical strength, stiffness, or other properties into the product. For example, in the case of poly-coated board, an embodiment of the invention can increase the thickness of the coating layer or use a higher density polyethylene to build stiffness into the paperboard.

In the case of secondary packaging, where few barrier properties are needed from the package, an embodiment of the invention can look to the image receptive outer layer (coating) to build the strength or stiffness.

The paperboard may be used to form an article as desired. Examples of suitable products that may be formed from or incorporate the present paperboard material include, but are not limited to, containers, e.g., packaging material, cups, plates, trays, clam-shells, card-stock for printed media (like marketing flyers), etc. In one embodiment, the article is a container comprising three or more adjacent walls defining an interior space. One ore more of the walls may comprise the paperboard material of the present technology. The walls may include a single layer wall formed from the paperboard, or a multi-layer wall (e.g., a multi-layer structure as described in FIGS. 2-4). In one embodiment, the paperboard may be used to form boxes. e.g., corrugated boxes as may be used in shipping materials. An embodiment of the invention provides thermal insulation properties to such articles such that food stays warm or the outer surface stays cool as in the case of paper cups where currently a separate corrugated paperboard is used.

In embodiments, the present paperboard material or a paperboard material incorporating the present paperboard may be employed to form a packaging material. The present paperboard products may be used to form primary packaging and/or secondary packaging materials. Primary packaging is in direct contact with the product and provides three distinct functions: (i) provides a print surface for branding and information. (ii) protects the product from the environment (for example moisture and/or oxygen), and/or (iii) assists with usage such as in microwaveable food products where the package absorbs the microwave energy to help with the cooking process. Examples of primary paperboard packaging include milk and juice cartons, ice cream tubs, and microwaveable food trays. In most of these cases the base paperboard is subsequently converted through a coating (like polyethylene) or a lamination (with aluminum foil) process. Typical converted paperboard products are: (a) paperboard/polyethylene (milk or ice cream packaging); (b) paperboard/polyethylene/foil/polyethylene (UHT—Ultra-Heat Treated—milk, juice, paste); and (c) paperboard/adhesive/metallized-polyethylene terephthalate (microwavable food trays).

For secondary packaging, any package that currently uses paperboard or a plastic can be envisioned to be replaced by this light weight paperboard product. Examples include, but are not limited to: (i) boxes for holding all manner of packaged foods such as cereal foods, packaged frozen foods. (ii) packaged pet foods, (iii) boxes used for packaging consumer items such as shampoo, beauty products that are sold in department stores, drug stores or any consumer goods store, and (iv) cartons for holding beverages such as 12 packs of soda, 6 packs of beer.

Aspects and embodiments of the invention are further understood and described with reference to the following examples:

EXAMPLES

The MFC and NFC used in the present study were obtained from the University of British Columbia (laboratory of Prof. Olson). The micro fibrillated cellulose had been mechanically refined using NBSK pulp from Canfor, at energies from 500 KWH/ton and ending at 2000 KWH/ton. This MFC had fiber length of about 0.3 mm and fiber diameter slightly larger than 1 micron. The NFC had fiber length of well below 0.3 mm and diameter of 0.5 micron.

Examples 1-11 relate to a series of trials on paperboards formed from various compositions. The compositions and data for Examples 1 through 11 are shown in Table 1. Generally, the procedure for producing the paperboards of Examples 1-11 follow the procedure discussed in Example 1, with the difference being the specific compositions used for the respective examples.

Example 1 (Comparative)

60 grams of Northern bleached softwood kraft (NBSK) pulp from CANFOR, with an average fiber length of 2.5 mm was dispersed in 3000 grams of water using an Arrow variable speed mixer (equipped with 3" pitched turbine blades) at 2000 rpm for 1 hour. About 375 grams of this aqueous slurry was cast on a cotton cloth enclosed in a 6" diameter Buchner funnel, allowed to drain, and very light vacuum applied when the flow of water almost stopped. Vacuum (0.9 bar) was applied for about 20 seconds and then the disc was transferred to a forced air oven maintained at 105° C. and dried for 1 hour. Thickness of the disc was measured over multiple regions and the average recorded. The disc was weighed and the volume of the disc calculated using the diameter and thickness from which the density of the dry foamed paperboard (0.37 g/cc) is calculated. The tensile strength (TS) was measured using Labthink XLB(B) Auto Tensile Tester (Labthink Instruments Co. Ltd.) with a half inch width sample and using a separation speed of 300 mm/min. An average of about 10 specimens was used for calculating the average and was evaluated to be 10.14 N/inch.

Example 2.0 Through 2.2 (Comparative)

An amount of NBSK pulp as shown in Table 1 was dispersed in water and after 1 hour of mixing. Polystep B-11 (60%) surfactant was added. Mixing was continued and after fixed intervals, samples were withdrawn and discs were prepared, dried, and measured for density and TS. The data shows a steady drop in TS as the density is lowered.

Example 3.0 Through 3.5 (Comparative)

An amount of NBSK pulp as shown in Table 1 was dispersed in water and after 1 hour of mixing, Fennostrength 4063 (Kemira Chemicals) was added to the pulp prior to adding Polystep B-11 surfactant. Now the pulp was foamed with good mixing. The amounts of FS 4063 added, density and TS are shown in Table 1. FS 4063 increases the TS of the paperboard initially but after foaming, even at high levels of FS 4063 (2%), the TS drops below the TS of the unfoamed paper (10 N/inch).

Example 4.0 Through 4.5 (Comparative)

Example 2 was carried out with MFC added to the pulp prior to adding Polystep B11 surfactant. The amounts of MFC added and properties of the resulting foamed paper are shown in Table 1. MFC improves the TS of the unfoamed paper but after foaming, TS starts to drop and at density of below 0.1 g/cc, it shows no substantial improvement over NBSK paper with no strength additives.

Example 5 Through 5.2 (Comparative)

Example 2 was repeated with NFC added to the pulp. At densities of below 0.12 g/cc, NFC shows no improvement over NBSK paper with no strength additives.

Example 6 Through 6.8

Examples 6-11 illustrate examples in accordance with aspects and embodiments of the invention. Example 6 was carried out with combination of NFC and Fennostrength 4063. A combination of 6% NFC and 2% 4063 was found to give dramatic improvement in TS at a density of 0.115. At less than one third the density of unfoamed NBSK paper, the TS was nearly 3 times higher. At a density of 0.02 g/cc (5% of density of unfoamed NBSK), the TS was equal.

A combination of NFC and Fennostrength 716 (Kemira Chemicals) (Examples 6.5 and 6.6) and NFC and Fennobond 3300 (Kemira Chemicals) (Examples 6.7 and 6.8) was also investigated. No synergy was seen between these additives and NFC, with no enhancement in TS.

Example 7 Through 7.6

Example 6 was repeated with a combination of MFC and Fennostrength 4063. The results are again very similar to those seen above with NFC and unexpected. There is a strong synergy between fibrillated cellulose (MFC and NFC) and the polyamide—EPI resin (4063) responsible for the strength development between the fibers even in the presence of a lot of air.

Example 8, 8.1, 9.0, 9.1, 10, 11

The synergy between MFC and 4063 was investigated with two other paper pulp fibers—recycled fibers (made up in the lab from various sources) and chemithermomechanical pulp (CTMP from QRP West Fraser, Canada). Similar enhancement in TS at low density was seen with both of these pulp types as seen with NBSK.

Figure 5:
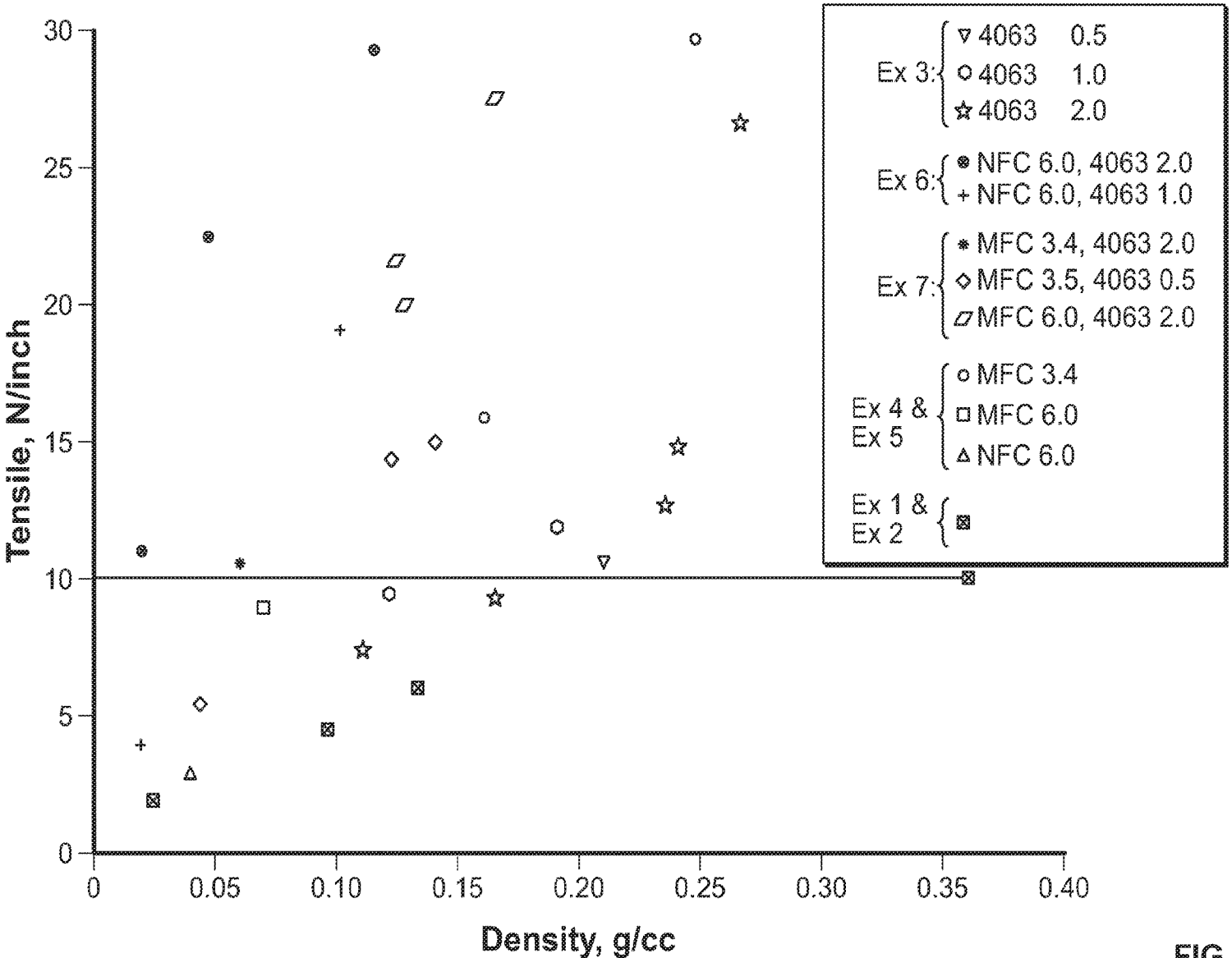
FIG. 5 is a graph showing the relationship of the density and tensile strength for the paperboards formed in Examples 1-11.

Data for the trials of Examples 1-11 are shown in Table 1. FIG. 5 shows the relationship between paperboard foam density and tensile strength for paperboards with and without several strength additives. The plot shows a steady drop in tensile strength as the density is lowered even with strengthening additives such as MFC, NFC and polyaminoamide epichlorhydrin (PAE). The solid flat line drawn at 10 Newtons/inch in FIG. 1 corresponds to the tensile strength of NBSK pulp paperboard made in the lab without foaming and without any additives. At density below 0.15 g/cc, the tensile strength of paperboard starts to drop dramatically even with significant amounts of strength additives such as PAE (0.5 to 2 wt % based on dry pulp), NFC and MFC (even as much as 10 wt % based on dry pulp) when used separately. It is also highly fortuitous that such a low level of NFC or MFC combined with PAE provides superior strength since (i) it is nearly 3 times as expensive as paper pulp, and (ii) high levels of MFC or NFC lead to undesirable side effects such as high water retention and higher energy for drying. TS

TABLE 1

| Example | Pulp, wt., grams | Water, liters | Additive, % on pulp | Surfactant, % on pulp | Weight of paperboard disc, grams | Density, g/cc | Tensile strength, N/in | Bulk, cc/g | Grammage, grams/sq m |
|---|---|---|---|---|---|---|---|---|---|
| 1.0 | NBSK, 60 | 3 | 0 | 0 | 9.74 | 0.370 | 10.14 | 2.7 | 534 |
| 2.0 | NBSK, 40 | 2 | 0 | Polystep B-11, 0.45 | 7.473 | 0.133 | 6.22 | 7.5 | 410 |
| 2.1 | NBSK, 60 | 3 | 0 | Bioterg AS 40, 0.4 | 6.016 | 0.097 | 4.57 | 10.3 | 330 |
| 2.2 | NBSK, 40 | 2 | 0 | Polystep B-11, 0.45 | 5.8 | 0.024 | 2.17 | 42.6 | 318 |
| 3.0 | NBSK, 60 | 3 | FS 4063, 0.5 | 0 | 10.114 | 0.282 | 23.92 | 3.5 | 555 |
| 3.1 | NBSK, 60 | 3 | FS 4063, 0.5 | Bioterg AS 40, 0.4 | 9.281 | 0.210 | 10.74 | 4.8 | 509 |
| 3.2 | NBSK, 40 | 2 | FS 4063, 1 | Bioterg AS 40, 0.2 | 6.875 | 0.192 | 12 | 5.2 | 377 |
| 3.3 | NBSK, 40 | 2 | FS 4063, 1 | Bioterg AS 40, 0.2 | 5.543 | 0.122 | 9.5 | 8.2 | 304 |
| 3.4 | NBSK, 80 | 4 | FS 4063, 2 | Bioterg AS 40, 0.1 | 9.822 | 0.233 | 12.7 | 4.3 | 539 |
| 3.5 | NBSK, 80 | 4 | FS 4063, 2 | Bioterg AS 40, 0.1 | 9.134 | 0.168 | 9.3 | 6.0 | 501 |
| 4.0 | NBSK, 60 | 3 | MFC, 3.4 | 0 | 10.935 | 0.370 | 36.1 | 2.7 | 600 |
| 4.1 | NBSK, 60 | 3 | MFC, 3.4 | Bioterg AS 40, 0.4 | 10.1 | 0.157 | 16.5 | 6.4 | 554 |
| 4.2 | NBSK, 80 | 4 | MFC, 6.0 | Polystep B 11, 0.45 | 7.86 | 0.072 | 9.25 | 13.9 | 431 |
| 4.3 | NBSK, 80 | 4 | MFC, 6.0 | Polystep B 11, 0.45 | 6.9 | 0.038 | 6.53 | 26.7 | 378 |
| 4.4 | NBSK, 80 | 4 | MFC, 1 | Polystep B 11, 0.45 | 9.158 | 0.074 | 5.32 | 13.5 | 502 |

TABLE 1-continued

| Example | Pulp, wt., grams | Water, liters | Additive, % on pulp | Surfactant, % on pulp | Weight of paperboard disc, grams | Density, g/cc | Tensile strength, N/in | Bulk, cc/g | Grammage, grams/sq m |
|---|---|---|---|---|---|---|---|---|---|
| 4.5 | NBSK, 80 | 4 | MFC, 1 | Polystep B 11, 0.45 | 6.05 | 0.032 | 2.61 | 31.3 | 332 |
| 5.0 | NBSK, 80 | 4 | NFC, 6 | Polystep B 11, 0.45 | 9.523 | 0.172 | 13.7 | 5.8 | 522 |
| 5.1 | NBSK, 80 | 4 | NFC, 6 | Polystep B 11, 0.45 | 8.5 | 0.122 | 6.54 | 8.2 | 466 |
| 5.2 | NBSK, 80 | 4 | NFC, 6 | Polystep B 11, 0.60 | 6.042 | 0.040 | 3.19 | 25.0 | 331 |
| 6.0 | NBSK, 80 | 4 | NFC, 6 + 4063, 2 | Polystep B 11, 0.563 | 9.11 | 0.115 | 32.47 | 8.7 | 500 |
| 6.1 | NBSK, 80 | 4 | NFC, 6 + 4063, 2 | Polystep B 11, 1.013 | 7.331 | 0.044 | 21.5 | 23.0 | 402 |
| 6.2 | NBSK, 80 | 4 | NFC, 6 + 4063, 2 | Polystep B 11, 1.576 | 5.58 | 0.021 | 10.02 | 48.8 | 306 |
| 6.3 | NBSK, 40 | 2 | NFC, 6 + 4063, 1 | Polystep B 11, 0.90 | 7.485 | 0.098 | 17.82 | 10.3 | 411 |
| 6.4 | NBSK, 40 | 2 | NFC, 6 + 4063, 1 | Polystep B 11, 2.7 | 4.61 | 0.021 | 3.63 | 47.6 | 253 |
| 6.5 | NBSK, 40 | 2 | NFC, 6 + FS 716, 2 | Polystep B 11, 2.25 | 8.302 | 0.200 | 29.6 | 5.0 | 455 |
| 6.6 | NBSK, 40 | 2 | NFC, 6 + FS 716, 2 | Polystep B 11, 3.6 | 4.553 | 0.025 | 3.94 | 40.8 | 250 |
| 6.7 | NBSK, 40 | 2 | NFC, 6 + FB 3300, 2 | Polystep B 11, 3.7 | 7.757 | 0.065 | 7.53 | 15.5 | 425 |
| 6.8 | NBSK, 40 | 2 | NFC, 6 + FB 3300, 2 | Polystep B 11, 3.8 | 5.16 | 0.025 | 4.46 | 40.0 | 283 |
| 7.0 | NBSK, 80 | 4 | MFC, 3.5 + 4063, 2 | Bioterg AS 40, 1.2 | 8.396 | 0.063 | 10.7 | 15.9 | 461 |
| 7.1 | NBSK, 80 | 4 | MFC, 6 + 4063, 2 | Bioterg AS 40, 0.675 | 10.173 | 0.173 | 30.29 | 5.8 | 558 |
| 7.2 | NBSK, 80 | 4 | MFC, 6 + 4063, 2 | Bioterg AS 40, 1.125 | 9.04 | 0.124 | 20.7 | 8.1 | 496 |
| 7.3 | NBSK, 80 | 4 | MFC, 3.5 + 4063, 0.5 | Bioterg AS 40, 045 | 9.29 | 0.131 | 14.89 | 7.6 | 510 |
| 7.4 | NBSK, 80 | 4 | MFC, 3.5 + 4063, 0.5 | Bioterg AS 40, 0.788 | 6.753 | 0.047 | 5.92 | 21.3 | 370 |
| 7.5 | NBSK, 80 | 4 | MFC, 6 + 4063, 0.5 | Bioterg AS 40, 0.45 | 9.75 | 0.132 | 21.75 | 7.6 | 535 |
| 7.6 | NBSK, 80 | 4 | MFC, 6 + 4063, 0.5 | Bioterg AS 40, 0.788 | 6.473 | 0.039 | 4.78 | 25.6 | 355 |
| 8.0 | Recycled pulp, 40 | 2 | 0 | Polystep B11, 0.675 | 4.14 | 0.081 | 8.28 | 12.3 | 227 |
| 8.1 | Recycled pulp, 40 | 2 | 0 | Polystep B11, 0.675 | 3.284 | 0.046 | 4.18 | 22.0 | 180 |
| 9.0 | Recycled pulp, 40 | 2 | MFC, 6 + FS 4063, 2 | Polystep B 11, 1.575 | 5.118 | 0.104 | 29.75 | 9.6 | 281 |
| 9.1 | Recycled pulp, 40 | 2 | MFC, 6 + FS 4063, 2 | Polystep B 11, 2.025 | 3.973 | 0.049 | 9.06 | 20.4 | 218 |
| 10.0 | CTMP, 40 | | 0 | Polystep B 11, 0.45 | 4.411 | 0.061 | 8 | 16.4 | 242 |
| 11.0 | CTMP, 40 | 2 | MFC, 6 + FS 4063, 2 | Polystep B 11, 0.45 | 4.15 | 0.047 | 16.1 | 21.5 | 228 |

Example 12 Through 18

Example 2 was repeated with Fennobond 3300 (Kemira), Cationic polyacrylamide, Cationic starch, Polyacrylic acid, Cellulose nano crystal, Acrysol ASE 95NP, and Expancel beads along with Fennostrength 716. The results are shown in Table 2.

TABLE 2

| Example | Pulp, wt., grams | Water, liters | Additive, % on pulp | Surfactant, % on pulp | Weight of paperboard disc, grams | Density, g/cc | Tensile strength, N/in | Bulk, cc/g | Grammage, grams/sq m |
|---|---|---|---|---|---|---|---|---|---|
| 12.0 | 100 | 5 | FB 3300, 1 | Bioterg AS 40, 0.4 | 6.047 | 0.095 | 4.7 | 10.5 | 746 |
| 12.1 | 60 | 3 | FB 3300, 3 | Bioterg AS 40, 0.4 | 9.377 | 0.094 | 7.2 | 10.6 | 514 |

TABLE 2-continued

| Example | Pulp, wt., grams | Water, liters | Additive, % on pulp | Surfactant, % on pulp | Weight of paperboard disc, grams | Density, g/cc | Tensile strength, N/in | Bulk, cc/g | Grammage, grams/sq m |
|---|---|---|---|---|---|---|---|---|---|
| 13 | 80 | 4 | CPAM, 3 | Polystep B 11, 0.4 | 8.673 | 0.263 | 6.86 | 3.8 | 476 |
| 13.1 | 80 | 4 | CPAM, 3 | Polystep B 11, 0.563 | 7.483 | 0.049 | 4.83 | 20.4 | 410 |
| 14 | 80 | 4 | Cationic Starch, Redibond 5330, 2.5 | Polystep B 11, 0.3 | 7.645 | 0.062 | 2.22 | 16.1 | 419 |
| 14.1 | 80 | 4 | Cationic Starch, Redibond 5330, 2.5 | Polystep B 11, 0.3 | 5.837 | 0.038 | 1.84 | 26.3 | 320 |
| 15 | 60 | 3 | PAA (Polysciences, MW = 345K), 0.83 | Bioterg AS 40, 0.4 | 10.03 | 0.278 | 26.5 | 3.6 | 550 |
| 15.1 | 60 | 3 | PAA (Polysciences, MW = 345K), 0.83 | Bioterg AS 40, 0.4 | 9.08 | 0.144 | 7.21 | 6.9 | 498 |
| 16 | 60 | 3 | CNC (Alberta Innovates), 3 | Bioterg AS 40, 0.4 | 9.387 | 0.094 | 6.52 | 10.6 | 515 |
| 16.1 | 60 | 3 | CNC (Alberta Innovates), 3 | Bioterg AS 40, 0.4 | 9.075 | 0.06 | 4.47 | 16.7 | 498 |
| 17 | 80 | 4 | Acrysol ASE 95NP, 1, FS 716, 0.4 | Bioterg AS 40, 0.3 | 9.88 | 0.245 | 30 | 4.1 | 542 |
| 17.1 | 80 | 4 | Acrysol ASE 95NP, 1, FS 716, 0.4 | Bioterg AS 40, 0.3 | 9.279 | 0.142 | 8.75 | 7.0 | 509 |
| 18 | 60 | 3 | Expancel 551WE 40, 4.8, FS 716, 0.86 | Bioterg AS 40, 0.4 | 13.811 | 0.319 | 12.12 | 3.1 | 758 |
| 18.1 | 60 | 3 | Expancel 551WE 40, 4.8, FS 716, 0.86 | Bioterg AS 40, 0.4 | 8.092 | 0.169 | 6.83 | 5.9 | 444 |

Figure 6:
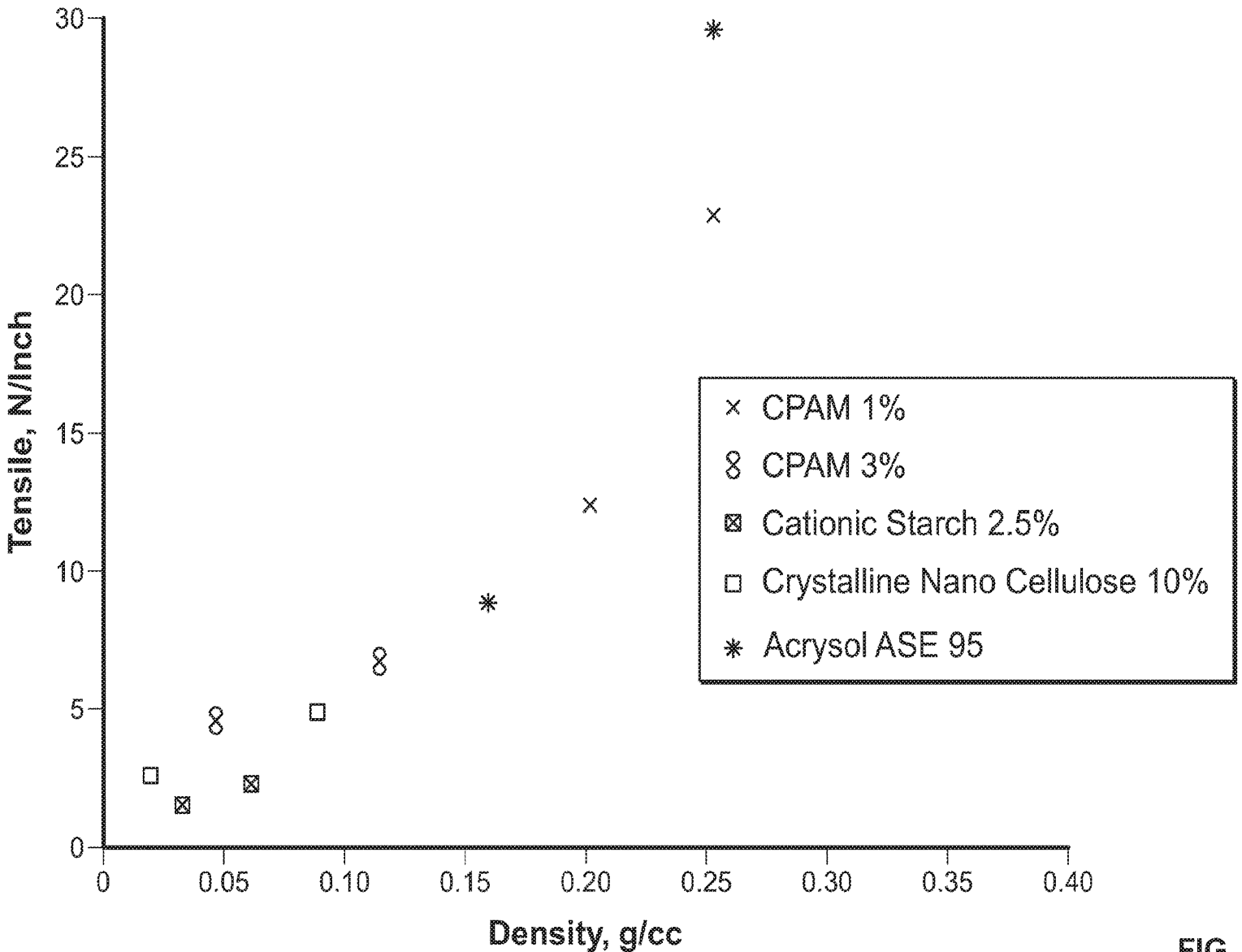
FIG. 6 is a graph showing the relationship of the density and tensile strength in paperboards using conventional strength additives.
Figure 7:
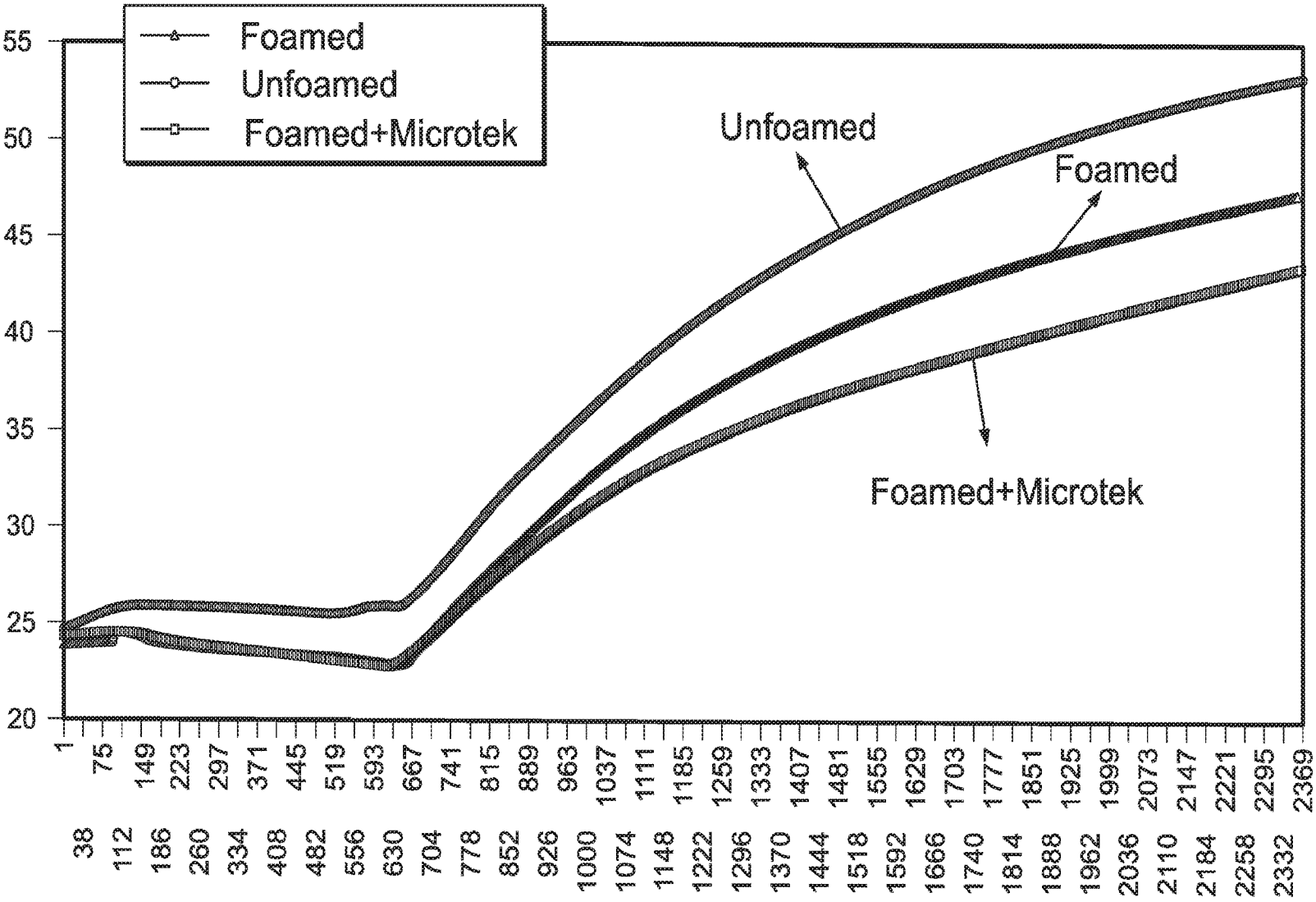
FIG. 7 is a graph comparing the insulating properties of boxes formed from different paperboards.

FIG. 6 shows TS vs density relationship with other conventionally known strength additives. The additives used included well known agents used to increase mechanical properties of conventional paper, such as cationic polyacrylamide, cationic starch, cellulose nano crystal, and glyoxylated polyacrylamide (GPAM). It is seen that with all these additives the TS drops steadily with lowering of density.

Example 19

A paperboard was made as per example 2 and had a TS of 2N/inch and a density of 0.044 g/cc. The thickness of the sheet was 0.516 cm. This sheet was laminated to a pressure-sensitive adhesive transfer tape and the TS of this laminate was 20.4 N/inch. A three mil metallized mylar film was laminated to the adhesive and the TS was measured to be over 50N/inch.

Example 20

A paperboard was made as per example 2 with a density of 0.044 g/cc and a thickness of 0.516 cm. A box was made using this sheet having dimensions of 3×2×1" and glued together with Elmer's glue. A temperature data logger (HOBO UX100-001 by Onset) was introduced into the box, the box was sealed with Elmer's glue, and maintained at RT for 10 minutes followed by introducing into an oven maintained at 60° C. After 30 minutes, the box was taken out and the temperature profile experienced by the HOBO in the box was plotted. The temperature in the box at the end of 30 minutes was 47.2° C.

Another box was made of the same dimensions using this paperboard and HOBO and 4 grams of phase change materials were introduced in the box—2 grams of Microteck MPCM 43D and 2 grams of Microtek MPCM 32 and subjected to the same temperature profile as the earlier box. The temperature in the box was 43.2° C.

Another box was made using paperboard made without foaming and having a density of 0.174 g/cc and a sheet thickness of 0.465 cm and subjected to the same profile as above. The temperature in the box was 53.2° C.

This shows that the foamed paperboard shows significant insulating properties—a 6° C. drop in interior temperature when subjected to an exterior temperature of 60° C. and a 10° C. drop with foam and phase change material. The data is shown in FIG. 1.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing description identifies various, non-limiting embodiments of a fibrous composition, a fibrous web, and paperboard formed from such materials. Modifications may occur to those skilled in the art and to those who may make and use the invention. The disclosed embodiments are merely for illustrative purposes and not intended to limit the scope of the invention or the subject matter set forth in the claims.

What is claimed is:

1. A composition forming a foamed structure, comprising:

(a) a fibrous material selected from a group including a cellulosic fiber, or a combination of the cellulosic fiber and a synthetic fiber;

(b) a fibrillated cellulose selected from a group including a microfibrillated cellulose, a nanofibrillated cellulose, or a combination thereof, a concentration of the fibrillated cellulose being up to about 10 wt %;

(c) a cross-linker, said cross-linker being a polyaminoamide epichlorohydrin, the concentration of the cross-linker being up to about 2.5 wt %;

(d) a surfactant;

(e) water;

wherein:

the foamed structure has a density less than about 0.15 g/cc;

the foamed structure that contains the fibrillated cellulose at the concentration in (b) above and does not contain the cross-linker has an average dry tensile strength less than the average dry tensile strength of the foamed structure that contains both the fibrillated cellulose at the concentration in (b) above and the cross-linker at the concentration in (c) above; and the foamed structure that contains the cross-linker at the concentration in (c) above and does not contain the fibrillated cellulose has the average dry tensile strength less than the average dry tensile strength of the foamed structure that contains both the fibrillated cellulose at the concentration in (b) above and the cross-linker at the concentration in (c) above.

2. The composition of claim 1, wherein the microfibrillated cellulose or the nanofibrillated cellulose or the combination of the microfibrillated cellulose and the nanofibrillated cellulose is present in an amount greater than 3.5 wt % based on the dry weight of the fibrous material.

3. The composition of claim 1, wherein the microfibrillated cellulose or the nanofibrillated cellulose or the combination of the microfibrillated cellulose and the nanofibrillated cellulose is present in an amount of from about 3.5 wt % to about 10 wt % based on the dry weight of the fibrous material.

4. The composition of claim 1, wherein the microfibrillated cellulose or the nanofibrillated cellulose or the combination of the microfibrillated cellulose and the nanofibrillated cellulose is present in an amount of from about 4 wt % to about 9 wt % based on the weight of dry fibrous material.

5. The composition of claim 1, wherein the microfibrillated cellulose or the nanofibrillated cellulose or the combination of the microfibrillated cellulose and the nanofibrillated cellulose is present in an amount of from about 5 wt % to about 7.5 wt % based on the weight of dry fibrous material.

6. The composition of claim 1, wherein the polyaminoamide epichlorohydrin is present in an amount of from about 0.5 wt % to about 2.5 wt %, based on the dry weight of the fibrous material.

7. The composition of claim 1, wherein the polyaminoamide epichlorohydrin is present in an amount of from about 0.75 wt % to about 2 wt %, based on the dry weight of the fibrous material.

8. The composition of claim 1, wherein the polyaminoamide epichlorohydrin is present in an amount of from about 1 wt % to about 1.5 wt %, based on the dry weight of the fibrous material.

9. The composition of claim 6, wherein the fibrillated cellulose is present in an amount of from about 3.5 wt % to about 10 wt % based on the dry weight of the fibrous material, and the polyaminoamide epichlorohydrin is present in an amount of from about 0.5 wt % to about 2.5 wt %, based on the dry weight of the fibrous material.

10. The composition of claim 9, wherein the composition is formed from a slurry comprising from about 30% by volume to about 60% by volume of a gas entrained therein.

11. The composition of claim 10, wherein the gas is chosen from a group including air, nitrogen, oxygen, argon, carbon dioxide, or combination thereof.

12. The composition of claim 1, wherein the cross-linker forms bridges between the cellulosic fiber and the microfibrillated cellulose, or between the cellulosic fiber and the nanofibrillated cellulose, or between the microfibrillated cellulose and the nanofibrillated cellulose.

13. A foamed paperboard formed from the composition of claim 1 or 11.

14. The foamed paperboard of claim 13, wherein the foamed paperboard has the average dry tensile strength of 10 N/inch or greater.

15. An article comprising the foamed paperboard material of claim 14.

16. The article of claim 15 in the form of a container comprising three or more walls defining an opening between the walls, wherein at least one of the walls comprises the foamed paperboard material.

17. The article of claim 16, wherein the at least one of the walls comprising the foamed paperboard material is a multilayer structure, and at least one of the layers is formed from the foamed paperboard material.

18. The article of claim 16, wherein the at least one of the walls comprising the foamed paperboard material is a multilayer structure comprising (i) the foamed paperboard, and (ii) at least a second paperboard having a tensile strength of greater than 10 N/inch.

19. The article of article of claim 17, wherein the multilayer structure comprises (i) the foamed paperboard disposed between (ii) a first paperboard material having tensile strength greater than 10 N/inch and a second paperboard material having a tensile strength of greater than 10 N/inch.

20. The article of claim 17, wherein the multilayer structure comprises (i) a first foamed paperboard having tensile strength of greater than 10 N/inch having an upper surface and a lower surface, (ii) an upper layer disposed on the upper surface of the first foamed paperboard, and (iii) a lower layer disposed on the lower surface of the first foamed paperboard, wherein the upper and lower layers are formed from a second and a third foamed paperboard.

21. The article of claim 17, wherein the multilayer structure comprises (i) a first foamed paperboard having tensile strength of greater than 10 N/inch having an upper surface and a lower surface, (ii) an upper layer disposed on the upper surface of the first foamed paperboard, and (iii) a lower layer disposed on the lower surface of the first foamed paperboard, wherein the upper and lower layers are formed from films selected from a group including a cellulose based film, a synthetic material film, a metallized film, wherein the upper and the lower layers comprise one or more properties selected from a group including barrier to gas, barrier to water, insulation and heat reflection.

* * * * *